United States Patent [19]

Holstein

[11] 4,008,741

[45] Feb. 22, 1977

[54] CARPENTER'S TOOL

[76] Inventor: Frederick W. Holstein, 1331 Howe St., Racine, Wis. 53403

[22] Filed: May 20, 1976

[21] Appl. No.: 688,158

Related U.S. Application Data

[62] Division of Ser. No. 601,313, July 31, 1975.

[52] U.S. Cl. ..... 145/46

[51] Int. Cl.[2] ..... B25C 3/00

[58] Field of Search ..... 145/46

[56] References Cited

UNITED STATES PATENTS

| | | | |
|---|---|---|---|
| 1,185,570 | 5/1916 | Zinn | 30/366 |
| 1,980,583 | 11/1934 | Gurley | 145/46 |
| 2,783,799 | 3/1957 | Hart | 145/46 |

*Primary Examiner*—Al Lawrence Smith
*Assistant Examiner*—J. T. Zatarga
*Attorney, Agent, or Firm*—Wegner, Stellman, McCord, Wiles & Wood

[57] ABSTRACT

A nail set tool to facilitate driving a nail set and having a resilient body with a truncated conical projection, an upper surface for receiving the impact force from a hammer blow, a lower surface of the projection adapted for bearing engagement with the workpiece, and an elongate axial hole extending therethrough for holding the nail set. The resilient body is compressed by the force of the blow received by the upper surface thereof and resiliently opposes the impact force with increased resilient force during increased compression to effectively limit the travel of the hammer, thus preventing overdriving of the nail set. The resilient body also shields the workpiece from the hammer. A flexible blade attached to the projection facilitates employment of the tool in otherwise inaccessible areas. The nail set has a shank extending through the hole, a boss overlying the upper surface of the body, and a head for receiving the hammer blow.

3 Claims, 7 Drawing Figures

CARPENTER'S TOOL

RELATED APPLICATION

This application is a division of application Ser. No. 601,313, filed July 31, 1975.

BACKGROUND OF THE INVENTION

This invention relates to a tool for holding a rigid element, such as a nail set, during the application of a hammer blow thereto and, more particularly, to such a tool which effectively prevents overdriving of the element under normal conditions and shields the workpiece.

The performance of finished carpentry work involves the sinking of narrow-head finishing nails beneath the surface of wood or wood-like workpieces. After a finished nail is driven into the workpiece, the resulting hole therein above the nail head is covered with a suitable filler to hide the nail hole and nail in the finished product. It is of the utmost importance that the nail is not overdriven and the workpiece struck by the hammer and thereby damaged. Accordingly, the driving of the finished nail by experienced carpenters is customarily only performed in two steps. First, the nail is only partially driven into the workpiece to a depth such that the head, and sometimes a portion of the shank, protrudes above the surface. The second step involves driving the nail beneath the surface, i.e., "setting" the nail, with a nail set punch.

This technique of setting nails suffers from more than a few disadvantages when only a conventional nail set punch and hammer are employed. First, as the nail head comes closer and closer to the surface of the workpiece, the danger of overdriving the nail increases. Accordingly, as the nail head approaches the surface, prudent carpenters decrease the force of each hammer blow, which thereby increases the number of strokes needed to drive the nail within the desired distance and adds to the time for completing the work. Next, due to the narrow end of the nail set having a diameter substantially the same as that of the nail, inattention often results in the nail set slipping off the head of the nail during or immediately before the punch is struck by the hammer. When this occurs, the workpiece is damaged by the nail set being driven into the workpiece alongside the nail. This slippage problem is aggravated when the location or configuration of the workpiece is such that it is difficult to coaxially align the nail set and the nail. Likewise, due to workpiece location, it is many times difficult to hold a nail in the desired location before application of the initial blow. Generally, because of these problems, the setting of nails during finish work has been a fatiguing and slow work process.

A number of devices have been proposed to resolve some of the difficulties noted above. Nail holders are shown in U.S. Pat. No. 3,060,442 of Tomek and U.S. Pat. No. 2,871,480 of Pezza et al. In Tomek, a headed nail is held between two resilient, flexible arms. When a nail is driven too far, the head of the nail acts against chamfered edges of the arms which are thereby separated to release the nail. However, the arms, while being somewhat resilient, are not intended to be struck by the hammer except by accident, and if struck, may cause damage to the workpiece. A further disadvantage of the Tomek holder is due to the resilient arms being attached to an elongate, substantially rigid body, for the rigidity of the body substantially prevents use of the nail holder in many inaccessible locations. In tne patent of Pezza et al, a punch is provided with a mechanism at one end thereof for holding the nail against the end of the punch whereby the punch itself functions as a holder. Again, however, a danger remains of driving the enlarged end of the punch into the workpiece. Accordingly, after the nail has been only partially driven into the workpiece, the hold on the nail is released and the punch is used in a conventional fashion.

A nail driving shield is shown in U.S. Pat. No. 3,338,279 of Kruttschnitt for preventing overdriving of the nail. The shield, however, is rigid, and if struck by the hammer with sufficient force, will indent the surface of the workpiece, particularly if the surface is curved. The disc-like shape and rigidity of the shield also prevents its effective use in corners or the like. A rigid shield especially designed for nailing tongue and groove flooring, but otherwise similar to the shield of Kruttschnitt, is shown in U.S. Pat. No. 3,010,496 of Bruce.

An attempted solution to the slippage problem is provided by a nail setting tool shown in U.S. Pat. No. 1,838,462 of Stanford, in which a punch housing fitted over the nail head maintains proper coaxial alignment. However, as with Pezza et al, no provision is made to prevent driving the punch housing into the workpiece along with the punch.

SUMMARY OF THE INVENTION

The disadvantages of known nail holders, nail set holders and shields are overcome in the carpenter's tool of the present invention through employment of a resilient flexible body for holding the nail or nail set during the application of a hammer blow. The body both resiliently shields the workpiece and resiliently opposes the impact force of the hammer blow to prevent overdriving the nail or nail set element. The resilient flexible body is provided with an upper surface for receiving the impact force of the hammer blow and a lower surface for bearing engagement with the workpiece. The element is received within an elongate hole extending between the upper and lower surfaces. The resilient body absorbs some of the force of the blow and compresses in the direction parallel thereto and thereby resiliently opposes the impact force with increased resilient force during increased compression.

In one embodiment, the carpenter's tool is adapted to function as a nail holder and shield. The nail is resiliently held within the elongate hole with its point, adjacent the lower surface, held against the workpiece, and its head protruding above the upper surface. After the nail has been driven beneath the upper surface of the body, the engagement of the hammer against the upper surface compresses the body, which then resiliently opposes the impact force of the hammer blow against the nail.

The closer the head of the nail to the surface of the workpiece, the further the resilient body must be compressed in order to contact the nail with the hammer, and the greater the force of the hammer blow needed to achieve the compression. In this manner the tool effectively prevents the head of the nail being flush with the workpiece. Rather, unless extraordinarily heavy blows are applied, the hammer, and thus the nail head, are limited from being driven closer than a selected distance from the surface of the workpiece depending upon the dimensions and resilience of the body.

An important feature of the present invention is that regardless how hard the upper surface of the body is struck, the body shields the workpiece from the hammer and, due to its resilience, cannot itself be driven into and therefore damage the workpiece, as can the rigid shields of the prior art.

A further important feature of the nail holder is a cavity in the lower surface coaxial with the hole and having a greater transverse dimension than that of the hole so that the resilient hold on the nail is released when it has been driven to the desired depth. Upon detecting the release of the hold on the nail, the carpenter is advised that the nail has been driven to the selected depth.

In another embodiment, the carpenter's tool is adapted to function as a holder for a special nail set. The nail set has a portion overlying the upper surface of the body and a shank extending through the hole which guides it into properly aligned engagement with a nail. The resilient opposing force of the body is thereby transmitted through the nail set to the hammer.

Yet another advantageous feature of the present invention employed in both embodiments is the provision of an elongate radially extending blade attached to the body which is also resiliently flexible so that it may be bent for access to corners or the like. Similarly, in accordance with another aspect of the invention, the body projects from the blade in a normal direction and is tapered toward the lower surface to further improve accessibility.

The foregoing and further advantageous features of the carpenter's tool will be described in the following description of the preferred embodiments and shown in the accompanying drawing.

BRIEF DESCRIPTION OF THE DRAWING

The description of the preferred embodiments will be given with reference to the several views of the drawing, of which.

DESCRIPTION OF THE PREFERRED EMBODIMENTS

Figure 1:
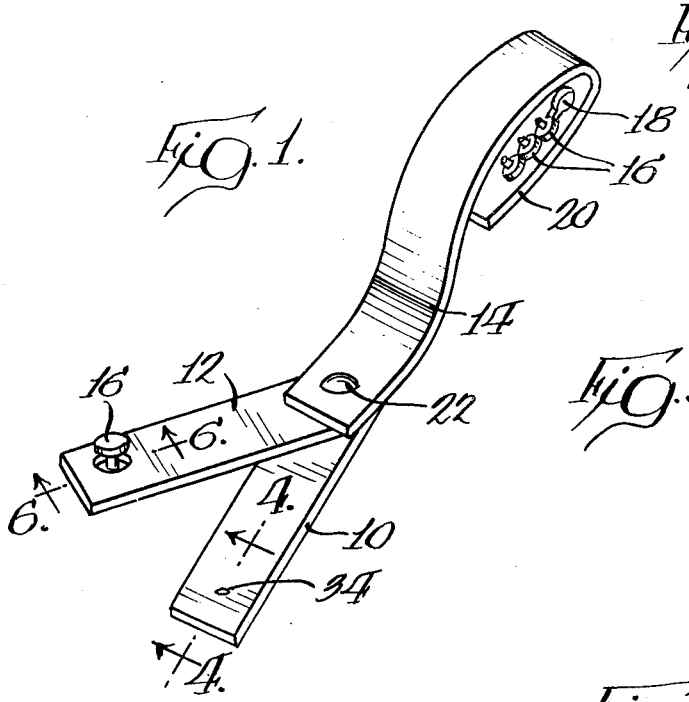
FIG. 1 is a perspective view of both the nail set holder and the nail holder embodiments of the present invention.

Referring to FIG. 1, the carpenter's tool is seen to have two forms: a nail holder 10 and a nail set holder 12. Both are attached to an elongate, substantially rigid handle 14. Nail set holder 12 may employ any one of a plurality of especially designed nail set elements 16 of different sizes. For convenience, handle 14 has a keyhole-shaped slot 18 in an underturned portion 20 thereof for carrying a plurality of the nail set elements 16 when not being used. The nail holder 10 and nail set holder 12 are pivotally connected to one end of handle 14 by means of a rivet 22 or the like. The pivotal connection permits movement of the nail holder 10 out of the way of the nail set holder 12 when the nail set holder is being utilized, and vice versa. Both nail set holder 12 and nail holder 10 may be pivoted to a location beneath handle 14 for compact storage when the tool is not being used. While both nail holder 10 and nail set holder 12 are attached to a single handle 14, it should be appreciated that separate handles could be provided for each.

Figure 4:
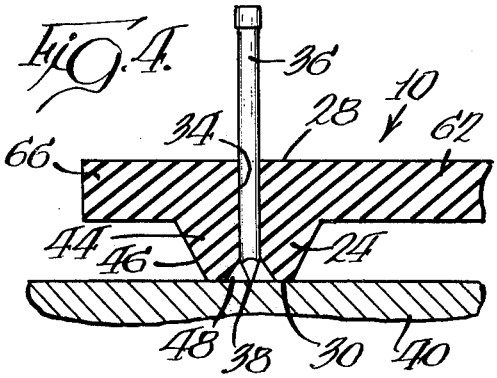
FIG. 4 is a view of a section of the nail holder embodiment taken along section line 4—4 of FIG. 1.
Figure 6:
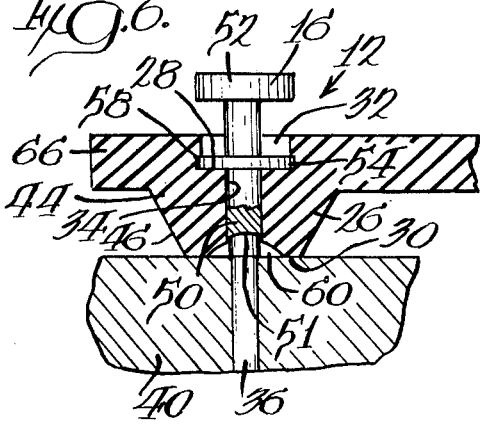
FIG. 6 is a sectional view of the nail set holder embodiment of the carpenter's tool taken along section line 6—6 of FIG. 1.

Referring now to FIGS. 4 and 6, holder 10 has a body 24, and holder 12 has a body 26 similar to body 24. Each of bodies 24 and 26 is made from flexible, resilient material, such as rubber or the like, and each has an upper surface 28 and a lower surface 30. The upper surface 28 of nail holder 10 is the uppermost or top surface of the body, while the upper surface 28 of body 26 is defined by the bottom of a recess 32 in the top surface of body 26. Each of bodies 24 and 26 also has an elongate hole 34 extending between upper surface 28 and lower surface 30 for resiliently holding a rigid element received therein.

Figure 5:
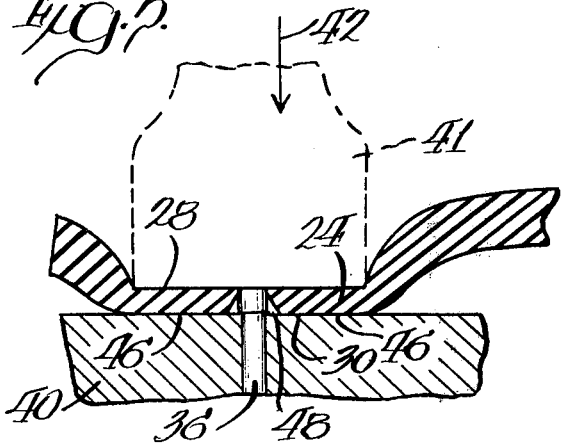
FIG. 5 is another sectional view similar to that of FIG. 4 and illustrating the compression of the body caused by the impact force of a hammer.

Referring specifically to FIG. 4, the rigid element held within hole 34 of nail holder 10 is a finish nail 36 or other like fastener 36. During use of nail holder 10, the nail is inserted through the hole and held in an upright position with its point 38 pressed up against the surface of the workpiece 40. The lower surface of body 24 is engaged with, and borne against, the work surface 40 to steady the tool against the workpiece. While being so held, one or more blows are applied to the head of nail 36 by means of a suitable hammer 41, as seen in FIG. 5. The hammer blows, of course, drive the nail into the workpiece 40 free of restraint from nail holder 10 until the nail head is driven sufficiently far into the workpiece that the nail head is beneath upper surface 28.

Referring to FIG. 5, after the nail is beneath upper surface 28, the impact force of each hammer blow to the nail is also received by the upper surface 28. The body 24 has a truncated conical projection 44, the side wall of which tapers inwardly toward hole 34 from adjacent upper surface 28 to lower surface 30. When upper surface 28 is struck with the hammer, the side wall 46 is pressed downwardly and expands in a direction transverse to that of the impact force, as indicated by arrow 42, until pressed against the surface of the workpiece 40.

Initially, when the upper part of side wall 46 is moving laterally to the impact force direction and is not constrained by the surface of the workpiece, compression, and thus the resilient opposing force, is minimal. However, as the hammer head moves closer to the workpiece, as is necessary to drive the nail deeper into the workpiece, the portion of the side wall 46 pressed against the workpiece increases, and a greater portion of the body 24 becomes compressed. As a greater amount of resilient body 24 is compressed, the resilient force developed therein opposing the downward travel of hammer 41 and nail element 36 increases. For example, the first ten pounds of pressure from the hammer may cause a 1/16 inch deflection, while thirty pounds of force may be required for the next 1/16 inch of compression. The size of projection 24 is selected in accordance with its resilience such that the body effectively limits the hammer from moving closer to the workpiece than a selected distance, such as 1/16 inch.

As seen in FIGS. 4 and 5, the lower surface 30 has a cavity 48 therein coaxial with hole 24. The cavity 38 has a depth substantially equal to, but slightly greater than, the 1/16 inch limiting distance and a transverse dimension greater than the diameter of the hole. Accordingly, the resilient hold on nail 36 by the hole is released when the element protrudes from the workpiece by an amount no greater than the limiting distance. Release of the resilient hold on the nail 36 provides an indication that the nail has been driven to the selected depth for use of the nail set holder 12.

Figure 7:
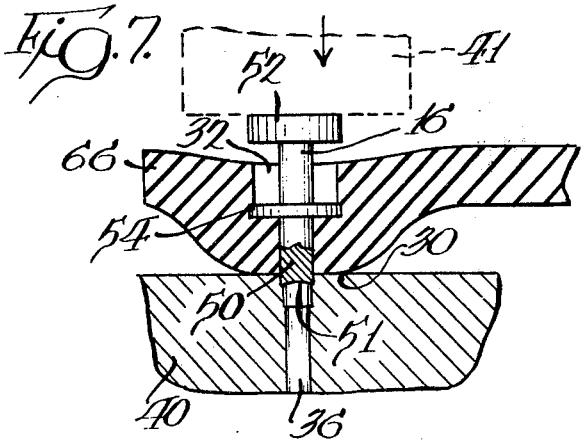
FIG. 7 is another sectional view of the nail set holder embodiment similar to that of FIG. 6 and illustrating the compression and other distortion of the body resulting from a hammer blow applied to the nail set element.

Referring to FIGS. 6 and 7, the nail set 16 of the invention has a shank 50 with a nail-engaging end 51, a head 52 attached to an end of the shank opposite end 51, and a boss 54 attached to the shank intermediate the head 52 and end 51. The head 52 projects above the top surface of body 26 for striking engagement with the hammer, while the under surface of the boss 54 overlies the upper surface 28 of recess 32. Nail-engaging end 51 of shank 50 is located adjacent lower surface 30 atop the head of nail 36. When the head 52 is struck by the hammer, the hammer force is transmitted through shank 50 to drive the nail head beneath the surface of the workpiece. As seen in FIG. 7, the impact force from the hammer is also transmitted to body 24 through engagement of the under surface of boss 54 with upper surface 28 such that the body is compressed when the nail set 16 is struck. The body 26 and the projection 44 resiliently oppose the impact force applied to the nail set through the engagement of the boss with the upper surface in substantially the same manner as body 24 of the nail holder 10.

A recess 60 similar to recess 48 is provided in under surface 30 of body 26 to facilitate alignment of the shank 50 with the nail head. The recess 60, which has a larger transverse dimension than that of hole 34, communicates with hole 34 at a distance from lower surface 30 which is less than the limiting distance of nail holder 10. Accordingly, the nail head projects slightly into the lower opening of hole 34 when is striking alignment with shank 50. In using the nail set holder, the body is slid over the nail head until the nail head enters recess 60 and is guided thereby into the opening of hole 34.

An annular lip 58 overlying a peripheral portion of the boss resiliently holds it in engagement with the upper surface with the shank in coaxial alignment within hole 34. A plurality of nail sets having equal boss diameters but different shank diameters less than that of the hole for different size nails may be effectively employed. The lip 58, by resiliently holding boss 54 against upper surface 28, prevents the nail set from being sprung out of the hole 34 by the force of the body returning to its uncompressed state at the completion of the hammer blow.

Figure 2:
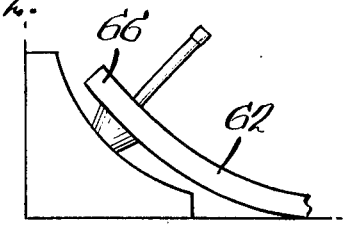
FIG. 2 is an illustration of the manner in which the carpenter's tool may be utilized on a nonplanar surface of a workpiece.
Figure 3:
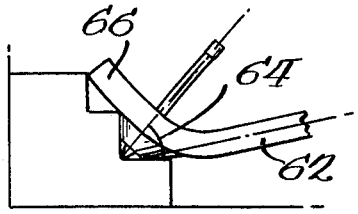
FIG. 3 is an illustration of the manner in which the blade or extension attached to the body of the tool may be bent to gain access to an interior corner.

Referring to FIGS. 2 and 3, another aspect of the carpenter's tool is the provision of an elongate, resilient blade or extension 62. One end is attached to the body of the nail holder and the other end is pivotally secured to the handle 14 as described above. The blade extends away from the body in a substantially radical direction with respect to the hole 34 and defines an angle 64 relative to the elongate axis of the hole, as best seen in FIG. 3. The resilience of blade 62 allows this angle to be manually altered to facilitate access by the tool to inside corners, concave curved surfaces, and other locations which would otherwise be inaccessible.

As can also be seen in FIG. 3, another advantage of the conical projection 44 and its tapered configuration is increased accessibility to interior corners and other like surfaces.

It should be appreciated that, due to the resilience of the body, the compression of lower surface 30 and side wall 46 against the work surface when struck by the hammer will not dent or otherwise mar the surface as can occur with rigid shields or nail set holders. Thus, for example, the tool can be used as a shield for a curved surface, as shown in FIG. 2, whereas a planar, rigid shield of the prior art would damage the surface if struck.

A short tab extension 66 attached to body 24 may also be provided diagonally opposite blade 62. The tab extension 66 increases the hammer-shielding surface of the tool and can be employed as an additional bearing surface when the tool is used in interior corners, as shown in FIG. 3. Preferably, the bodies 24 and 26 may be integrally formed with their respective tab extensions 66 and blades 62 by a suitable molding process.

I claim:

1. A nail set tool for limiting the travel of a nail set toward a workpiece when a hammer blow is applied, said tool having a resilient flexible body with an upper surface for receiving the impact force of a hammer blow, a lower surface for bearing engagement with the workpiece during the application of the blow, means defining a recess at the upper surface of said body, and an elongate hole extending between the recess and said body lower surface for guiding the nail set during the application of the blow, said nail set having an elongate shank extending into the hole with a nail-engaging end located adjacent the lower surface, a head attached to and having a transverse dimension greater than that of the shank and projecting above the upper surface for striking engagement with a hammer, and a boss attached to the shank between the head and the end of the shank and positioned in said recess with an under surface thereof engaged with a bottom of said recess, resilient means on said body engaging said boss to hold the nail set on said body and said boss against the bottom of said recess and said flexible body being compressed to resiliently oppose the impact force applied to the nail set through the engagement of the boss with the upper surface.

2. The nail set tool of claim 1 wherein the resilient means comprises a lip overlying a portion of the boss when inserted into the recess to resiliently hold the nail set in engagement with the body.

3. The nail set tool of claim 2 with a plurality of said nail sets, each of said nail sets having a different shank diameter less than the transverse dimension of the hole, and said body includes means engageable with the boss of each of said nail sets for holding the shank within the hole.

* * * * *